US007276094B2

(12) United States Patent
Factor et al.

(10) Patent No.: US 7,276,094 B2
(45) Date of Patent: Oct. 2, 2007

(54) MIXED METAL CATALYST ADDITIVE AND METHOD FOR USE IN HYDROCARBONACEOUS FUEL COMBUSTION SYSTEM

(75) Inventors: Stephen A. Factor, Richmond, VA (US); Joseph W. Roos, Mechanicsville, VA (US); Allen A. Aradi, Richmond, VA (US)

(73) Assignee: Ethyl Petroleum Additives, Inc., Richmond, VA (US)

( * ) Notice: Subject to any disclaimer, the term of this patent is extended or adjusted under 35 U.S.C. 154(b) by 480 days.

(21) Appl. No.: 10/721,156

(22) Filed: Nov. 25, 2003

(65) Prior Publication Data

US 2005/0108923 A1 May 26, 2005

(51) Int. Cl.
*C10L 1/30* (2006.01)

(52) U.S. Cl. ..... 44/358; 44/359; 44/360; 44/369; 44/370; 44/373; 44/450; 44/603; 431/2; 431/3

(58) Field of Classification Search ..... 44/360, 44/359, 358, 369, 370, 373, 450, 603; 431/2, 431/3

See application file for complete search history.

(56) References Cited

U.S. PATENT DOCUMENTS

| | | | | |
|---|---|---|---|---|
| 2,818,417 | A | | 12/1957 | Brown et al. |
| 3,837,820 | A | | 9/1974 | Kukin |
| 3,891,401 | A | * | 6/1975 | Watson et al. ..... 44/359 |
| 4,047,875 | A | | 9/1977 | May et al. |
| 4,568,357 | A | | 2/1986 | Simon |
| 4,674,447 | A | | 6/1987 | Davis |
| 4,690,687 | A | | 9/1987 | Johnston et al. |
| 4,973,336 | A | | 11/1990 | Gheysens |
| 5,113,803 | A | | 5/1992 | Hollran et al. |
| 5,599,357 | A | | 2/1997 | Leeper |
| 5,919,276 | A | | 7/1999 | Jeffrey |
| 5,944,858 | A | | 8/1999 | Wallace |
| 6,197,075 | B1 | | 3/2001 | Muir et al. |
| 6,632,257 | B1 | | 10/2003 | Feitelberg et al. |
| 2005/0108923 | A1 | | 5/2005 | Factor et al. |

FOREIGN PATENT DOCUMENTS

| | | | |
|---|---|---|---|
| CN | 1334323 | | 6/2002 |
| DE | 2248068 | | 4/1973 |
| DE | 3429584 | | 11/1985 |
| EP | 0 466 512 | B1 | 6/1994 |
| EP | 04026457.4 | | 6/2005 |
| GB | 490064 | | 2/1937 |
| GB | 1189356 | | 4/1970 |
| GB | 2 248 068 | A | 3/1992 |
| JP | 2002038169 | | 2/2002 |
| JP | 2002-540286 | | 11/2002 |
| JP | 2003-261890 | * | 9/2003 |
| JP | 2003261889 | | 9/2003 |
| JP | 2003261890 | | 9/2003 |
| WO | WO82/01375 | A1 | 4/1982 |
| WO | WO95/23836 | A1 | 9/1995 |
| WO | WO 00/58422 | A1 | 10/2000 |

OTHER PUBLICATIONS

Dobbins et al., "The Evolution of Soot Precursor Particles in a Diffusion Flame," Combustion and Flame, 115, pp. 285-298 (1998).
Vander Wal et al., "Soot Oxidation: Dependence Upon Initial Nanostructure," Combustion and Flame, 134, pp. 1-9, (2003).
Haynes et al., "The Effect of Metal Additives on the Formation of Soot in Premixed Flames," 17th Symposium on Combusion, pp. 1365-1374, The Combustion Institute 1979.
Howard et al., "Soot Control of Fuel Additives," Prog. Energy Combust. Sci., vol. 6, pp. 263-276, Pergamon Press Ltd. 1980.
Cotton et al., "The Suppression of Soot Emissions From Flames by Metal Additives," Combustion and Flame, 17, p. 87 (1971).
Translation of Japanese Notice of Reasons for Rejection; 2 pages; Date drafted Oct. 27, 2006; Date of Dispatch Nov. 7, 2006.
United Kingdom Patent Specification; 490,064; Application Date Feb. 17, 1937; 3 pages.

* cited by examiner

*Primary Examiner*—Cephia D. Toomer
(74) *Attorney, Agent, or Firm*—John H. Thomas, P.C.

(57) ABSTRACT

A hydrocarbonaceous fuel additive, fuel composition, and method all lower both carbon particulate emissions and improve slag properties in combustion systems including, for instance, utility furnaces and boiler systems. The mixed metal catalyst may include a transition metal-containing compound, an alkali metal compound, and a magnesium-containing compound.

9 Claims, No Drawings

MIXED METAL CATALYST ADDITIVE AND METHOD FOR USE IN HYDROCARBONACEOUS FUEL COMBUSTION SYSTEM

This invention relates to a hydrocarbonaceous fuel additive, fuel composition and method that both improves the combustion of the fuel and improves the slag resulting from the combustion of the fuel. Specifically, the additive, fuel composition and method include the use of the combination of a manganese-containing compound, at least one alkali metal compound, and a magnesium-containing compound.

BACKGROUND

Utility furnaces and industrial boiler systems operating with atmospheric burners, like all hydrocarbonaceous fuel combustion systems, are concerned with the amount and quality of the emissions that result from the combustion of fuel in those systems. Particulate emissions are a byproduct of incomplete combustion. This carbon-containing particulate is an environmental issue, and to solve it, fuel compositions are constantly being modified and combustion methods designed to minimize the amount of particulate emitted into the environment. Other emission constituents can form deposits on various parts of the combustion system, for instance, the water wall pipes, economizer tubes, and/or super heater tubes of utility furnaces and industrial burner systems. The deposits, typically referred to as slag, may build up and, over time, significantly reduce the efficiency of the combustion system.

Metal-containing additives have been used in fuel formulations to catalyze carbon burn out, and thereby reduce particulate emissions, by either inhibiting particulate agglomeration (alkali metals), enhancing carbon oxidation at peak combustion temperatures by increasing hydroxyl radical concentration (alkaline earth metals), or by increasing the rate of catalytic oxidation by lowering the particulate light-off temperature (transition metals). It is recognized, however, that use of these specific metal-containing additives may adversely affect the type and/or quantity of slag that may build up in a combustion system.

In one example, the prior art discloses a method for reducing emissions which include the use of a mixture of calcium and either alkali metals, alkaline earth metals other than calcium or mixtures thereof. See U.S. Pat. No. 5,919,276.

It is also known that adding magnesium compounds to fuels extends the time between combustion turbine maintenance when burning ash-containing fuel. See, e.g., U.S. Pat. No. 6,632,257. However, magnesium does not impact carbon burnout. Magnesium compounds, therefore, positively affect the type and/or quantity of slag, but do not impact carbon burnout.

DETAILED DESCRIPTION

A hydrocarbonaceous fuel additive, fuel composition, and method lowers both carbon particulate emissions and improves slag properties in combustion systems including, for instance, utility furnaces and boiler systems. The fuel additive package, fuel composition and method of the present invention combine the benefit of a mixed metal catalyst that improves carbon light-off and thereby reduces carbon particulate emissions and the benefit of magnesium for improving slag formation on, for instance, water wall pipes, economizer tubes, and super heater tubes of utility furnaces. In one alternative, the additive package contains the mixed metals transition metal-containing compound/alkali metal compound/magnesium-containing compound, in one example having a ratio of about 1/1/3 transition metal alkali metal/Mg. The additive package herein is made compatible with hydrocarbonaceous fuels commonly used in connection with various combustion systems. It is this unique combination of metal catalysts that is able to deliver the dual benefits of reduced carbon particulate emissions and improved slag properties resulting from the combustion of the fuel.

In one example, a hydrocarbonaceous fuel additive comprises a transition metal-containing compound, at least one alkali metal compound, and a magnesium-containing compound. In another example, a fuel composition comprises a major amount of hydrocarbonaceous fuel and minor amount of an additive, the additive comprising a transition metal-containing compound, an alkali metal compound, and a magnesium-containing compound. In a still further example, a method of improving the combustion of, and the slag resulting from the combustion of, a hydrocarbonaceous fuel comprises the steps of providing a hydrocarbonaceous fuel comprising a transition metal-containing compound, an alkali metal compound, and a magnesium-containing compound; combusting the fuel in a combustion system, wherein the combustion of the fuel causes the formation of slag and carbon burnout; wherein the amount of transition metal, alkali metal and magnesium contained in the fuel is in an amount effective to improve the combustion of the fuel, or reduce particulate emissions, and improve the slag resulting from combustion of the fuel.

The discussion herein is addressed to a hydrocarbonaceous fuel additive, to a fuel composition, and to a method for improving the combustion of and the slag resulting from the combustion of a hydrocarbonaceous fuel. In each instance, a constant is the presence of a mixed metal catalyst combination comprising at least one transition metal-containing compound/alkali metal/magnesium-containing compound.

In one example, the transition metal-containing compound is an organometallic compound. Exemplary transition metal-containing organometallic compounds herein include compounds with stabilizing ligands containing functional groups such as alcohols, aldehydes, ketones, esters, anhydrides, sulfonates, phosphonates, chelates, phenates, crown ethers, naphthenates, carboxylic acids, amides, acetyl acetonates, and mixtures thereof. The transition metals of this invention include manganese, iron, cobalt, copper, platinum, palladium, rhodium, ruthenium, osmium, iridium, molybdenum, scandium, yttrium, lanthanum, cerium, and mixtures thereof. Manganese-containing organometallic compounds include manganese tricarbonyl compounds. Such compounds are taught, for example, in U.S. Pat. Nos. 4,568,357; 4,674,447; 5,113,803; 5,599,357; 5,944,858 and European Patent No. 466 512 B1.

Suitable manganese tricarbonyl compounds which can be used include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. One example is the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc.

Preparation of such compounds is described in the literature, for example, U.S. Pat. No. 2,818,417, the disclosure of which is incorporated herein in its entirety.

Alkali metal compounds useful herein can include the following: lithium, sodium, potassium, rubidium and mixtures thereof. These metals may be combined with the fuel as compounds or salts, for instance, of the following acidic substances or mixtures thereof: (1) sulfonic acids, (2) carboxylic acids, (3) alkylphenols, (4) sulfurized alkylphenols, and (5) organic phosphorus acids characterized by at least one direct carbon-to-phosphorus linkage. The metal salts may be prepared as oil-soluble overbased salts. The term "overbase" is used to designate metal salts wherein the metal is present in stoichiometrically larger amounts than the organic acid radical.

In another example, the alkali metal compounds or salts are oil-insoluble and may be, for example, dispersions, emulsions, mists, sprays, powdered, or atomized.

In one example, the alkali metal is potassium and the compound is potassium sulfonate, a fuel soluble compound.

Examples of magnesium-containing compounds include the following: neutral or overbased magnesium compounds derived from: (1) sulfonic acids, (2) carboxylic acids, (3) alkylphenols, (4) sulfurized alkylphenols, and (5) organic phosphorus acids characterized by at least one direct carbon-to-phosphorus linkage.

In one example, the magnesium-containing compound is magnesium sulfonate, a fuel soluble compound.

Hydrocarbonaceous fuels that benefit from the additive described herein include those fuels that produce carbon particulate emissions when combusted and that also form slag in combustion systems once they have been combusted. These fuels include, for instance, diesel fuel, No. 1, No. 2, No. 4, No. 5 and No. 6 fuel oils, combinations thereof, and other fuels commonly used in utility and industrial burner systems. Other examples of fuels suitable for use in the operation of combustion units described herein include hydrocarbonaceous fuels such as but not limited to diesel fuel, jet fuel, alcohols, ethers, kerosene, low sulfur fuels, synthetic fuels, such as Fischer-Tropsch fuels, liquid petroleum gas, fuels derived from coal, coal, genetically engineered biofuels and crops and extracts therefrom, natural gas, propane, butane, unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds. Other fuels that may be useful include gasoline, bunker fuel, coal (dust or slurry), crude oil, refinery "bottoms" and by-products, crude oil extracts, hazardous wastes, yard trimmings and waste, wood chips and saw dust, agricultural waste, fodder, silage, plastics and other organic waste and/or by-products, and mixtures thereof, and emulsions, suspensions, and dispersions thereof in water, alcohol, or other carrier fluids. By "diesel fuel" herein is meant one or more fuels selected from the group consisting of diesel fuel, biodiesel, biodiesel-derived fuel, synthetic diesel and mixtures thereof.

Other components may be included within the additives and/or fuel compositions described herein provided they do not adversely affect the amount or formation of slag otherwise obtained herein. Thus, use may be made of one or more of such components as corrosion inhibitors, antioxidants, anti-rust agents, detergents and dispersants, fuel lubricity additives, demulsifiers, dyes, inert diluents, cold flow improvers, conductivity agents, metal deactivators, stabilizers, antifoam additives, de-icers, biocides, odorants, drag reducers, combustion improvers, oxygenates and like materials.

Combustion systems that may benefit from the additives or fuel compositions herein include any system that, as a result of the combustion of a hydrocarbonaceous fuel, has emissions of carbon particulate matter and that includes components on which slag may build up or form. Water wall pipes, economizer tubes, and super heater tubes of utility and industrial furnaces are common locations where slag may build up. By "combustion system" herein is meant any and all internal and external combustion devices, machines, boilers, incinerators, evaporative burners, plasma burner systems, plasma arc, stationary burners and the like which can combust, or in which can be combusted, a hydrocarbonaceous fuel. The combustion units further include any and all burners or combustion devices, including for example and without limitation herein, stationary burners, waste incinerators, diesel fuel burners, gasoline fuel burners, power plant generators, power plant furnaces, and the like. The hydrocarbonaceous fuel combustion systems include all combustion units, systems, devices, and/or engines that burn or oxidatively decompose hydrocarbonaceous fuels.

Examples of treat rates of the mixed metal compounds described herein include any treat rates that both improve the particulate emissions and improve the quality of the slag resulting from the combustion of the fuel. For purposes herein, the term "improve" or "improving" means that the additive, fuel composition or method will have lower particulate emissions and more favorable slag qualities (less build up, more easily cleaned, less dense, less rigid, less adhesive, more friable, etc.) than additives, fuel compositions, and methods that do not include the mixed metal catalyst described herein. In one example, the transition metal-containing compound is included in an additive package or a fuel composition in an amount sufficient to supply about 0.1 to 40 ppm manganese metal to the fuel composition. In another example, the fuel soluble alkali metal is included in an additive or to a fuel composition in an amount sufficient to supply from 0.1 to 40 ppm alkali metal to the fuel composition. And in a further example, the amount of slag modifying magnesium-containing compound is included in an additive or a fuel composition in an amount sufficient to supply from about 0.3 to 600 ppm magnesium metal to the fuel composition. In another example, the magnesium amount is 20 to 60 ppm in the fuel composition. The mass ratio or proportion of the three metal components is, in one example, approximately 1/1/3, manganese-containing compound/alkali metal/magnesium-containing compound. In other examples, the ratio can range from 1/1/1 to 1/2/1 to 1/1/15.5.

EXAMPLE

The result below illustrates the effectiveness of mixed metal catalysts in lowering the light-off temperature of carbon, thereby reducing carbon particulate emissions.

TABLE 1

Single-Metal versus Mixed-Metal Catalysts Performance in Carbon-Light-Off.

| Metal Additive Mixture | Carbon Light-Off (° C. TGA) | ° C. Lowered by Additive |
|---|---|---|
| None | 627 | 0 |
| Fe | 588 | 39 |
| Mn | 560 | 67 |
| Cu | 426 | 201 |
| Cu/Mn/K | 421 | 206 |
| Mn/K | 412 | 215 |

The carbon light-off tests were conducted by TGA on graphite samples treated by the respective metal additive or additive combination. The treatment was by incipient impregnation of the additive from water soluble metal salts, into the graphite.

Graphite was chosen as the surrogate carbon particulate because of its difficulty to light-off. Therefore it serves as a good carbon substrate on which to compare different light-off catalysts. In addition, the light-off temperatures in Table 1 should be considered as very conservative, and the temperatures that would be seen in the real world with actual carbon-containing combustion particulate would be even lower.

The results in Table 1 show the advantage with respect to carbon particulate emissions of using mixed metal catalysts over their single metal components. This is because in the mixed metals, each metal acts on the carbon in different temperature regimes and the enhanced benefit is due to the metal that acts in the first temperature regime conditioning the particulate for a more efficient reaction with the second metal. For example, in the case of the Mn/K mixed metal catalyst system, the K interacts with the soot in the high temperature regime as it is forming and keeps it dispersed in the oxidizing fuel/air charge. As the temperature begins to fall from peak, the Mn becomes the dominant oxidation catalyst interacting with this high surface area deposit, and lowering the light-off temperature thus catalyzing oxidation at lower temperatures. If the K did not interact with the soot before it aggregated to larger particle sizes, then the surface area exposed to Mn oxidation would be greatly lowered thus decreasing the efficiency of the Mn catalyst.

The aforementioned mixed metal catalyst systems do not provide improved slag modification.

Some metals such as magnesium do not participate in particulate burn out chemistries, but are known instead to be efficacious combustion slag modifiers resulting in a more friable slag that is more easily removed from a combustion system.

When a fuel is formulated such that the two features above are incorporated—reduction in carbon light-off temperature and slag modification, then one can have a fuel composition that simultaneously lowers carbon-containing particulate emissions, and also modifies and improves the slag resulting from combustion of this fuel in utility and industrial furnaces.

Thus, according to an embodiment of the present invention, a mixed, three-metal combustion catalyst system added to a hydrocarbonaceous fuel can result in simultaneous (1) combustion improvement such as lower carbon particulate emissions, and (2) generation of slag which is more friable, less adhesive, less dense and reduced in total volume or mass, relative to slag from fuel combustion lacking the present mixed three-metal catalyst system.

A combustion unit plant trial was conducted in which No. 6 fuel oil containing 1% sulfur and 50 ppm vanadium was combusted in an industrial boiler system. The combustion and power generation unit was operated at a 330 MW production rate with a maximum capacity of 385 MW. The experiment lasted for one month during which time slag quality and particulate emissions were observed. A mixed catalyst system containing manganese and magnesium in an approximately one to three weight ratio was injected into the fuel combustion unit of the boiler system. A reduction of 39% in carbon particulate emissions was achieved during the trial. In addition, visual observations of the slag accumulating on the walls of boiler steam tubes showed a surprisingly different and improved character, texture and volume when compared to visual observations of boiler steam tubes with slag from fuel combusted in the absence of the present mixed metal catalyst.

Visual observation of the water wall tubes in the utility furnace burning number 6 fuel oil without the magnesium additive showed heavy glass-like slag with teardrop ends as a result of gravity induced flow. The spaces between the tubes through which the combustion gases are supposed to flow were highly restricted by the slag deposit. When the utility furnace unit was operated with fuel containing a mixed metal additive package comprising a manganese-containing compound and a magnesium-containing compound, the slag appeared dry, more friable, and less glass like. The combustion gas flow spaces between the water wall tubes were much less restricted. The magnesium had clearly modified the slag by increasing its melting temperature above that in the furnace surface environment. As a result, most of the particulates in the combustion gas solidify before they reach the surfaces. Some of the particulate reach the surface still molten and serve as a substrate to hold the non-molten magnesium-modified bulk combustion particulate. Thus the slag ends up being composed of a major portion of solid particulate embedded in a minor portion of molten material. This leaves spaces between the bound solid particulate which gives the resultant slag a friable property.

More specifically, the slag generated appeared softer, like dripping candle wax, looser and reduced in volume or mass. This change in appearance and improvement in properties is a result of the inclusion of magnesium to a manganese-containing catalyst system previously designed for combustion improvement and particulate reduction. The invention relates to the further inclusion of an alkali metal combustion improver to this transition metal-containing and magnesium-containing catalyst system.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as formation of the organometallic compound) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations or immediately thereafter is thus wholly immaterial for an accurate understanding and appreciation of this disclosure and the claims thereof.

At numerous places throughout this specification, reference has been made to a number of U.S. patents, published foreign patent applications and published technical papers. All such cited documents are expressly incorporated in full into this disclosure as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Patentee does not intend to dedicate any disclosed embodiments to the public, and to the extent any disclosed modifications or alterations may not literally fall within the scope of the claims, they are considered to be part of the invention under the doctrine of equivalents.

What is claimed is:

1. A method of improving the combustion of and the slag resulting from the combustion of a hydrocarbonaceous fuel composition, the method comprising the steps of:

providing a hydrocarbonaceous fuel composition comprising a transition metal-containing organometallic compound, at least one alkali metal compound, and a magnesium-containing compound, the amount of magnesium-containing compound is an amount sufficient to supply about 60 to 600 ppm magnesium metal to the fuel composition;

combusting the fuel composition in a combustion system, wherein the combustion of the fuel composition causes the formation of slag;

wherein the amount of transition metal, alkali metal and magnesium contained in the fuel composition is in an amount effective to improve the combustion of the fuel composition and improve the slag resulting from combustion of the fuel;

whereby the slag is improved and the improvement to the slag is selected from the group comprising slag that is more easily removed, is less built up, and is more friable.

2. The method as described in claim 1, wherein the transition metal-containing compound, alkali metal compound, and magnesium-containing compound are included in the additive in a ratio of about one part manganese, one part alkali metal, and three parts magnesium of the respective metals.

3. The method as described in claim 1, wherein the organometallic compound is a compound with a stabilizing ligand containing a functional group selected from the group consisting of alcohols, aldehydes, ketones, esters, anhydrides, sulfonates, phosphonates, chelates, phenates, crown ethers, naphthenates, carboxylic acids, amides, acetyl acetonates and mixtures thereof.

4. The method as described in claim 1, wherein the organometallic compound comprises manganese.

5. The method as described in claim 4, wherein the manganese-containing compound is selected from the following group: cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and mixtures of two or more such compounds.

6. A method as described in claim 1, wherein the alkali metal compound contains an alkali metal selected from the group consisting of lithium, sodium, potassium and rubidium.

7. A method as described in claim 1, wherein the magnesium-containing compound is selected from the group of compounds derived from sulfonic acids, carboxylic acids, alkylphenols, sulfurized alkylphenols, and organic phosphorus acids and mixtures thereof.

8. A method as described in claim 1, wherein the amount of transition metal-containing organometallic compound is an sufficient amount to supply about 0.1 to 40 ppm transition metal to the fuel composition.

9. A method as described in claim 1, wherein the amount of alkali metal is an amount sufficient to supply about 0.1 to 40 ppm alkali metal to the fuel composition.

* * * * *

UNITED STATES PATENT AND TRADEMARK OFFICE

CERTIFICATE OF CORRECTION

PATENT NO. : 7,276,094 B2
APPLICATION NO. : 10/721156
DATED : October 2, 2007
INVENTOR(S) : Stephen A. Factor, Joseph W. Roos and Allen A. Aradi It is certified that error appears in the above-identified patent and that said Letters Patent is hereby corrected as shown below:

On the title page, item [73]:
Please delete the assignee "Ethyl Petroleum Additives, Inc." and insert --Afton Chemical Corporation--

Signed and Sealed this

Eleventh Day of December, 2007

JON W. DUDAS
*Director of the United States Patent and Trademark Office*